US006986348B2

(12) United States Patent
Carter

(10) Patent No.: US 6,986,348 B2
(45) Date of Patent: Jan. 17, 2006

(54) COUGH-A-LIZER

(76) Inventor: Michael Terry Carter, 7 Read Dr., Sicklerville, NJ (US) 08081

( * ) Notice: Subject to any disclaimer, the term of this patent is extended or adjusted under 35 U.S.C. 154(b) by 45 days.

(21) Appl. No.: 10/948,720

(22) Filed: Sep. 22, 2004

(65) Prior Publication Data

US 2005/0034722 A1 Feb. 17, 2005

Related U.S. Application Data

(63) Continuation-in-part of application No. 10/153,953, filed on May 23, 2002, now abandoned.

(51) Int. Cl.
*A62B 7/00* (2006.01)
*A61M 16/00* (2006.01)
*G10K 11/00* (2006.01)

(52) U.S. Cl. ..... 128/201.25; 128/201.26; 181/21; 181/175

(58) Field of Classification Search ..... 128/201.13, 128/201.11, 201.23, 201.25, 201.26, 205.25, 128/205.27, 205.29, 206.12, 206.15, 206.21, 128/206.29, 207.12, 205.24; 181/21, 175, 181/252, 253, 254, 256, 258, 272
See application file for complete search history.

(56) References Cited

U.S. PATENT DOCUMENTS

| | | | | | |
|---|---|---|---|---|---|
| 3,889,776 | A | * | 6/1975 | Postma | 181/258 |
| 4,792,013 | A | * | 12/1988 | Boynton | 181/242 |
| 4,932,495 | A | * | 6/1990 | Chapman | 181/242 |
| 5,117,821 | A | * | 6/1992 | White | 128/206.15 |
| 5,269,294 | A | * | 12/1993 | Rogozinski | 128/205.27 |
| 5,386,825 | A | * | 2/1995 | Bates | 128/205.27 |
| 5,413,094 | A | * | 5/1995 | McBrearty | 128/200.24 |
| 6,085,864 | A | * | 7/2000 | Copeland et al. | 181/242 |
| 6,401,860 | B1 | * | 6/2002 | Ellington et al. | 181/242 |

* cited by examiner

*Primary Examiner*—Teena Mitchell

(57) ABSTRACT

The germ and noise filter device is a disposable, hand held filter apparatus that covers the mouth of the user during the exhale phase of a cough. The device comprises: a body with a cavity that houses three micro-filters; a corrugated tube; two one-way valves and a mesh screen. The body can be made of durable plastic material that may be transparent or a combination of many attractive colors. The two one-way valves act as a filter element for the noise that would normally occur. An eyelet is formed on the body to allow the device to be worn about the person. When a cough is eminent, the opening of the device is engaged against the user lips to prevent the transmission of air-borne diseases and reduce the noise of the coughs.

1 Claim, 2 Drawing Sheets

FIG. 1 .
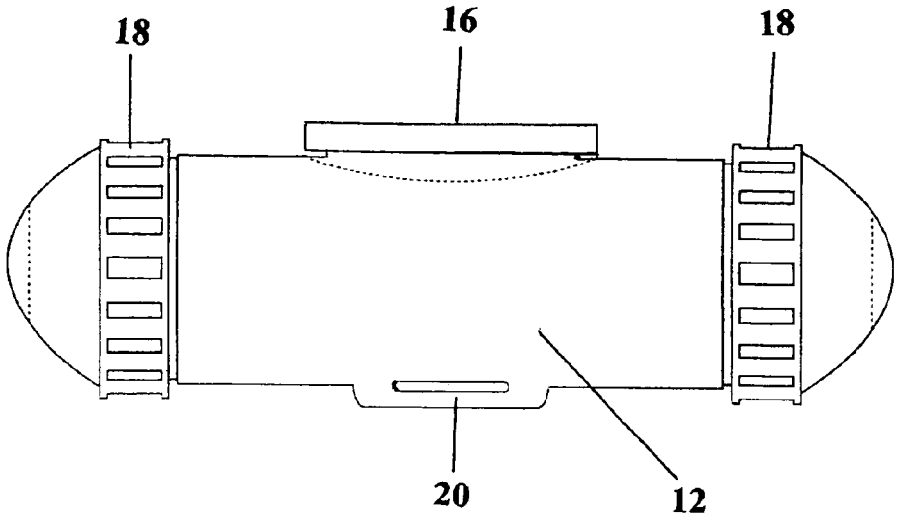
FIG. 4a.
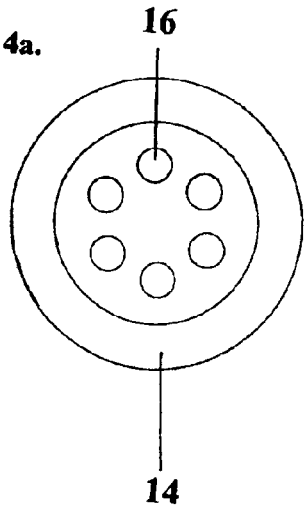
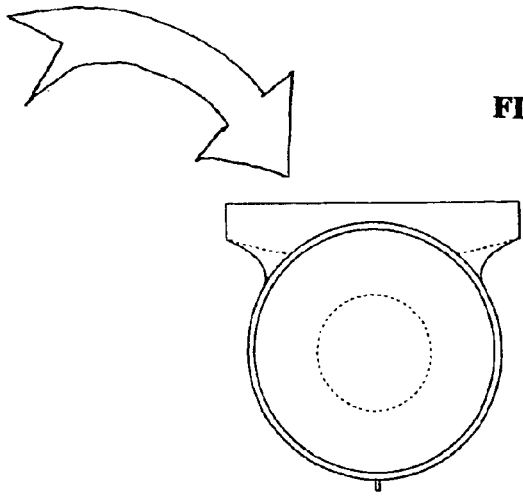
FIG. 4b.

FIG. 2.
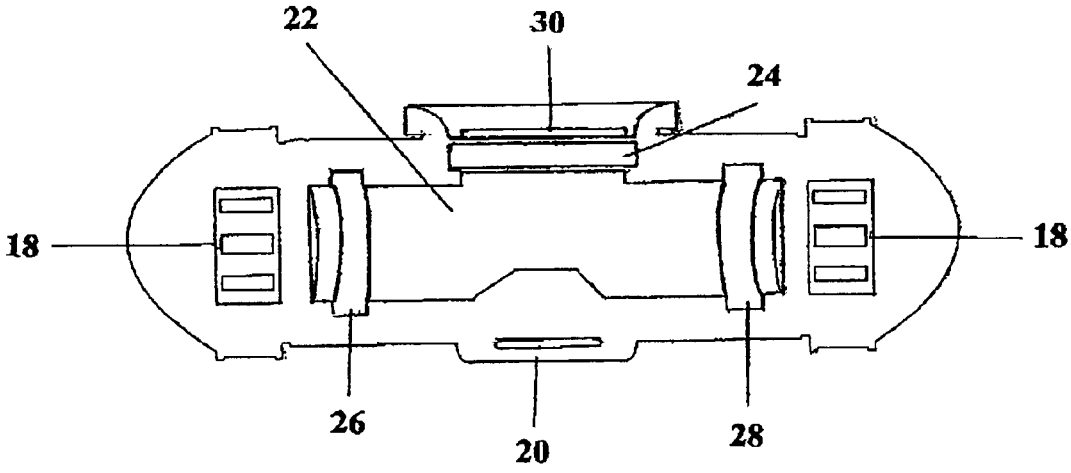
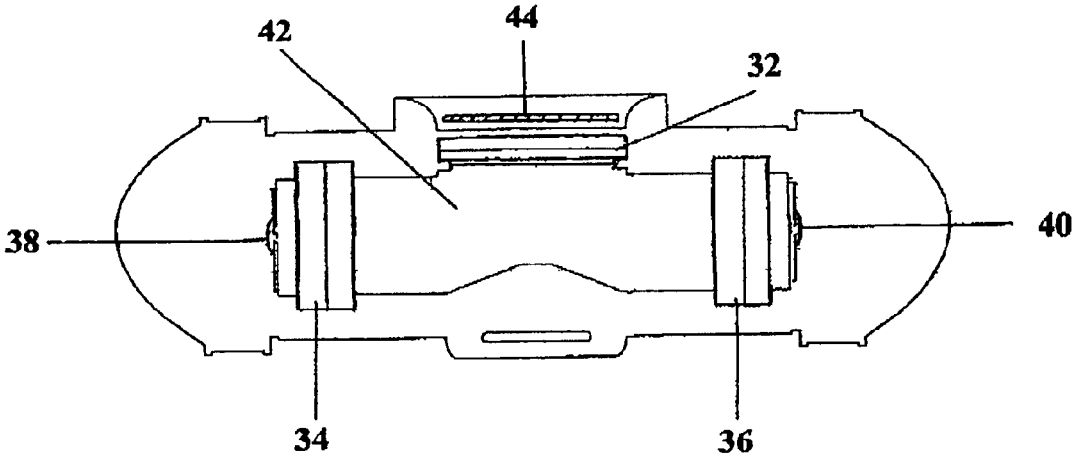
FIG. 3.

COUGH-A-LIZER

This application is a continuation-in-part of Ser. No. 10/153,953, filed May 23, 2002, now abandoned.

BACK GROUND OF THE INVENTION

The germ and noise filter device relates generally to the field of public health, more particularly to the field of germ prevention. The device is designed to protect other persons from contaminants expelled from the user with cold and flu like symptoms and decrease the noise that normally occur from coughs. The following U.S. patents reflect the state of the art of which the applicant are aware insofar as they are somewhat pertinent to the present invention: U.S. Pat. No. 3,719,188 to Fisher et al.; U.S. Pat. No. 4,834,212 to Figone et al.; U.S. Pat. No. 4,792,013 to Boynton; U.S. Pat. No. 4,932,495 to Chapman: U.S. Pat. No. 5,413,094 to McBrearty; U.S. Pat. No. 5,367,377 to Shinabarger; U.S. Pat. No. 6,085,864 to Copeland et al; and U.S. Pat. No. 6,401,860 to Ellington et al.

The patent to Fisher et al. discloses a cough filter device comprising a perforated container, mouth piece and cover. The container is lined with a filter material to trap vapors and micro-organisms. The device is kept in a pocket or purse for convenience. In use the device is opened and mouth piece is placed to the user mouth to catch expelled vapors.

The patent to Figone et al. discloses a human muffler to be held around the user mouth which includes a microphone and electric circuit for receiving unabsorbed sounds.

The Boynton patent discloses a globe-like device for muffling the cries of an infant.

The Chapman patent discloses a device for muffling vocal sounds, particularly coughing and sneezing sounds made by hunters and the like, and covers both the nose and mouth of the user.

The patent to McBrearty discloses a device which has a core made of a noise reduction material that fits over the user's mouth and nose.

The patent to Shinabarger discloses a cylindrical device with a handle. The device comprised of alternating layers of rigid and soft foam. The device include a circular mouth-piece member.

The patent to Copeland et al. discloses a cup-shaped casing, mouthpiece which extends into and out of the cup-shaped casing, and two pieces of absorbent material. The device deaden coughs and other vocal sounds made by hunters, bird watchers and the like.

The patent to Ellington et al. discloses a cough silencer device comprising a body, cavity and mouth portion. An internal muffling baffling system within the cavity is attached to the mouth portion. In use, the mouth portion is placed into the user mouth and allow the internal baffling system to silence the cough.

The present germ and noise filter invention is different than these patents in that it provides an improved disposable filter system and unique noise reduction means for coughs related to cold and flu like symptoms. In reference to the patent, Fisher et al, the present germ and noise filter device clearly distinguish itself not only by it's noise reduction feature, but also it's unique components. The micro-filters not only effectively filter virus and bacteria but also serve as part of the noise reduction feature due to their strategic location.

The corrugated tubing ability to absorb and channel large air volume and moisture is another component that separate the present invention from the prior art patents. Because of the unique ability of the corrugated tubing to accommandate forceful exhalation with out restricting output is a tremendous advantage for people with respiratory ailments. In the patent to Fisher et al, the perforated holes of the device are located in the side walls adjacent to the bottom of the container for the accumulation of moisture.

The perforated entrance and mesh screen of the present invention is another unique component. The location of the mesh screen in relation to the perforated opening prevents mucus and saliva from clogging the micro-filters. A distinct advantage from the open mouth piece of the fisher patent.

Another unique component of the present germ and noise filter device are the one way valves which allow for a certain amount of airflow differential to be achieved resulting in decrease noise volume that the Fisher patent does not have. Because of it's location to the micro-filters and corrugated tubing, it also expedite filtered air and moisture decreasing the potential for bacteria and germs to grow.

SUMMARY OF THE INVENTION

According to the present invention, there is potentially significant benefit to a simple non-invasive device capable of reducing the noise volume of coughs while decreasing the spread of germs. One of the most compelling arguments for the present invention was the Severe Acute Respiratory Syndrome or (S.A.R.S) scare that threaten a global epidemic. Common cold and flu viruses are transmitted in this airborne route due to coughs. The present invention is convenient for regular use by adults and children, medical and non-medical personnel, inside and outside of hospitals and health care setting, large or small offices, schoolrooms, private residence and other places of gathering.

The germ and noise reduction filter device of the present invention in brief summary comprises: a "T" shaped body having a cavity therein with a perforated opening to be engaged by the user lips. The body may be made of durable plastic material that can be transparent or any one or combinations of attractive colors. An eyelet is formed on the body to allow the device to be conveniently worn about the person of the user. Venting slots are provided on the body. A filter system is deposed within the cavity as well as a means to decrease the noise of coughs.

The object of the present invention will become more readily apparent from the following description in conjunction with the accompanying drawings.

BRIEF DESCRIPTION OF DRAWINGS

FIG. 1. is a perspective view of the germ and noise filter invention.

FIG. 2. is a cross-sectional view to show interior construction of the germ and noise filter invention.

FIG. 3. is a cross sectional view to show internal components of the germ and noise filter invention and how they associate with each other.

FIG. 4*a*. is a top plain view of the rim and perforated opening of the germ and noise filter invention.

FIG. 4*b*. is a plain side view of the germ and noise filter invention

DETAIL DESCRIPTION OF THE PREFERRED EMBODIMENT

The device used for reduction in audio expiration output and decrease in microscopic germ particles are provided.

The drawings discloses a preferred embodiment of the present invention, reference is made first to FIG. 1 which illustrate various components of the present invention being a cough filter and noise reduction device comprising a "T" shaped body 12, a perforated opening 16 and venting slots 18 therein. An eyelet 20 is formed to allow the body 12 to be conveniently worn about the person. The body 12 may be made of durable plastic material which may be transparent or a combination of many attractive colors.

FIG. 2. illustrates mesh screen slot 30, cavity 22, and filter holders 24,26 and 28

FIG. 3. illustrates the placement of the mesh screen 44 just below the rim and perforated entrance opening; placement of filters 32, 34, and 36, between corrugated T-tube 42 to remove air-borne viruses from the expelled breath of the user and exit through one-way valves 38 and 40. The preferred filter material has been tested and found to have a filtration rate of 99.99% for bacteria and 99.90% for virus; a high saturation tolerance; disposable and free of natural rubber latex. Product number SJ1503 manufactured by BIO-MEDIC INC, P.O. BOX 7343 San Clemete, Calif. 92676

FIG. 4*a* and 4*b*. Illustrates perforated opening 16 which includes a rim 14 adapted to engage the lips of the user to ensure a good seal and a plain side view of the germ and noise filter device.

Filter 32 removes microorganisms from the exhale flow stream of perforated opening 16; corrugated T-tube 42 absorbs and streamline airflow and moisture from filter 32 toward filters 34 and 36 where remaining microorganisms are removed.

One-way valves 38 and 40 quickly purge the filtered air-stream from filters 32, 34, and 36, streamlined by corrugated T-tube 42 where it exit through vents 18 to the atmosphere. One-way valves 38 and 40 further allows for a degree of airflow differential of generated sound to be achieved resulting in noise reduction of coughs.

In use the filter and noise reduction device 12 is suspended from the user person in a convenient spot, when a cough is imminent, the rim 14 of oval opening 16 is engaged against the user lips to catch any expelled air-borne microorganisms and to reduce the sound made by the cough. Although the exhale air may engage the filters at various locations in the exhale flow stream, the filters enable microorganisms to be removed and accomplish a level of protection to other persons or things.

Although the fore going invention has been described in some detail by way of illustrations for the purpose of clarity, it should be understood that many, modifications, variations and other applications will become apparent to those skilled in the art after considering this specification and accompanying drawings. There fore, any and all changes, modification, variations and other uses and application which do not depart from the spirit and scope of the present invention are deemed to be covered by the invention which is limited only by the following claims.

What is claimed is:

1. A disposable cough filter and noise reduction device comprising: A T-shaped body comprising: a corrugated tube having a cavity therein and three orifices; at one end of the T-shaped body, one perforated orifice, which allows a user to cough into allowing exhale air to enter the cavity; said perforated orifice comprising a mesh screen covering a micro-filter; wherein the mesh screen prevents mucus and saliva from a user from clogging the micro-filter; two orifice at opposite ends of the T-shaped body which allow exhale air to pass from an interior space of the cavity to an exterior of the T-shaped body; said two orifice comprising micro-filters and one-way valves, the one-way valves acting to muffle the noise of the user when the user coughs into the T-shaped body; the T-shaped body at said two orifices also comprising venting slots, which assist in allowing the exhaled air to pass to said exterior of said T-shaped body.

* * * * *